US011141671B2

(12) United States Patent
Harter et al.

(10) Patent No.: US 11,141,671 B2
(45) Date of Patent: Oct. 12, 2021

(54) SELF-SEALING BALLOONS AND RELATED COMPONENTS AND METHODS OF MANUFACTURING

(71) Applicant: KBIDC INVESTMENTS, LLC, Austin, TX (US)

(72) Inventors: Kendall D. Harter, Spicewood, TX (US); Jon Y. Yamamoto, Farmers Branch, TX (US); A. Scott Goodwin, Farmers Branch, TX (US)

(73) Assignee: KBIDC Investments, LLC, Austin, TX (US)

( * ) Notice: Subject to any disclaimer, the term of this patent is extended or adjusted under 35 U.S.C. 154(b) by 533 days.

(21) Appl. No.: 15/706,120

(22) Filed: Sep. 15, 2017

(65) Prior Publication Data

US 2018/0056200 A1 Mar. 1, 2018

Related U.S. Application Data

(63) Continuation of application No. 13/974,888, filed on Aug. 23, 2013, now abandoned.

(51) Int. Cl.
*A63H 27/10* (2006.01)

(52) U.S. Cl.
CPC ..... *A63H 27/10* (2013.01); *A63H 2027/1075* (2013.01); *A63H 2027/1083* (2013.01)

(58) Field of Classification Search
CPC .... A63H 2027/1025; A63H 2027/1041; A63H 2027/1083; A63H 2027/1091
(Continued)

(56) References Cited

U.S. PATENT DOCUMENTS 560,444 A * 5/1896 Temple ..... B65D 39/06 215/266
1,111,642 A 9/1914 Brucker
(Continued)

FOREIGN PATENT DOCUMENTS

| | | |
|---|---|---|
| CN | 201055553 | 5/2008 |
| GB | 294273 | 7/1928 |
| WO | 95/23095 | 8/1995 |

OTHER PUBLICATIONS

Kickstarter, Inc, Bunch O Balloons, Jul. 21, 2014; URL: https://www.kickstarter.com/projects/bunchoballoons/bunch-o-balloons-100-water-balloons-in-less-than-1, 13 pages.
(Continued)

*Primary Examiner* — Laura Davison

(57) ABSTRACT

Balloons and related components and manufacturing methods. Various embodiments provide balloons which define elastomeric balloon bodies and necks. The balloon bodies define body thicknesses and filled and unfilled internal volumes. Tension in the balloon bodies gives rise to internal pressures when the balloons are filled. The necks couple with the bodies and define neck thickness which differ from the body thicknesses. Various embodiments provide check valve for use with the balloons and/or various liquids. These check valves can comprise a ball that further comprises a generally spherical substrate of fine particles of a biodegradable material and a coating on the substrate. The coating can be made of another biodegradable material. Combined, the coating and the generally spherical substrate form the check valve ball mid possess a density differing from the water density.

6 Claims, 12 Drawing Sheets

(58) Field of Classification Search
USPC ..... 446/224
See application file for complete search history.

(56) References Cited

U.S. PATENT DOCUMENTS

| | | | | |
|---|---|---|---|---|
| 1,136,932 | A | 4/1915 | Brucker | |
| 1,447,848 | A | 3/1923 | Holycross et al. | |
| 1,629,838 | A | 5/1927 | Perdue | |
| 2,197,617 | A | 4/1940 | Magran | |
| 2,436,684 | A | 2/1948 | Annis | |
| 2,617,624 | A | 11/1952 | Annis | |
| 2,691,849 | A * | 10/1954 | Ehlers, Sr. ..... | A47G 7/00 47/41.11 |
| 2,960,994 | A | 11/1960 | Shaffer | |
| 3,852,194 | A | 12/1974 | Zine, Jr. | |
| 4,071,045 | A | 1/1978 | Brandt | |
| 4,586,456 | A | 5/1986 | Forward | |
| 5,370,266 | A | 12/1994 | Woodruff | |
| 5,988,415 | A | 11/1999 | White | |
| 6,007,403 | A | 12/1999 | Urspringer et al. | |
| 6,016,828 | A | 1/2000 | Machledt | |
| 7,322,073 | B2 | 1/2008 | Cuisinier | |
| 8,540,073 | B2 * | 9/2013 | Lang ..... | A63H 27/10 206/459.5 |
| 2004/0174718 | A1 | 9/2004 | Ohlund | |
| 2005/0176339 | A1 | 8/2005 | Cuisinier | |
| 2007/0238835 | A1 | 10/2007 | Chen | |
| 2013/0118640 | A1 | 5/2013 | Saggio | |
| 2014/0030452 | A1 | 1/2014 | Warner et al. | |
| 2014/0212074 | A1 | 7/2014 | Durst | |

OTHER PUBLICATIONS

International Search Report in Application No. PCT/US2014/052350 dated Feb. 10, 2015, 4 pages.
International Preliminary Report in Application No. PCT/US2014/052350 dated Feb. 23, 2016, 7 pages.
Office Action in Canadian Application No. 2,922,173 dated Jan. 16, 2017, 4 pages.
European Search Report in Application No. 14838705.3 dated Jan. 4, 2017, 10 pages.
Office Action in U.S. Appl. No. 13/974,888 dated Mar. 5, 2015, 20 pages.
Office Action in U.S. Appl. No. 13/974,888 dated Jul. 27, 2015, 11 pages.
Office Action in U.S. Appl. No. 13/974,888 dated Dec. 9, 2015, 7 pages.
Office Action in U.S. Appl. No. 13/974,888 dated Jun. 22, 2016, 26 pages.
Office Action in U.S. Appl. No. 13/974,888 dated May 16, 2017, 24 pages.
Office Action in EP Appl. No. 14838705.3 dated Mar. 14, 2018, 8 pages.
Examination report in Australian Appl. No. 2014308672 dated Sep. 23, 2019, 7 pages.

* cited by examiner

SELF-SEALING BALLOONS AND RELATED COMPONENTS AND METHODS OF MANUFACTURING

The present application is a continuation of U.S. application Ser. No. 13/974,888, filed Aug. 23, 2013; the disclosure of which is incorporated by reference herein in its entirety.

BACKGROUND

People of all ages enjoy water balloon fights particularly during hot weather. These mock battles allow people to blow off a bit of steam in a good-natured way without harming anyone else. Indeed, during most water balloon fights the worst that happens is that someone gets soaked and everyone gets a good laugh.

One player or side of a water balloon fight often wins based on the number of balloons that they can throw during the fight. The throw rate of course depends on being able to fill and tie off the balloons. But, both activities can demand more dexterity than many small children possess. It is also something of a tedious task for those not involved in the game (for instance, the parents who might be assisting their children).

SUMMARY

The following presents a simplified summary in order to provide an understanding of some aspects of the disclosed subject matter. This summary is not an extensive overview of the disclosed subject matter, and is not intended to identify key/critical elements or to delineate the scope of such subject matter. A purpose of the summary is to present some concepts in a simplified form as a prelude to the more detailed disclosure that is presented herein. The current disclosure provides balloons, self-sealing water balloons, components thereof and related systems, apparatus, methods, etc.

Some embodiments provide self-sealing water balloons. The balloons of the current embodiment comprise an elastomeric body, rib, and check valve ball. The balloon body defines a body thickness, an unfilled internal volume, and a filled internal volume. Furthermore, the balloon body expands between the unfilled internal volume and the filled internal volume when filled with fluid. Moreover, when filled, it has an internal pressure arising from a tension in the elastomeric balloon body. The balloon rib is coupled to the balloon body and defines a meniscus region and a rib thickness. The rib thickness is greater than the body thickness in the current embodiment. As to the check valve ball, it is buoyant and is located within the balloon body. Accordingly, the balloon is configured so that a combination of the internal pressure and the buoyancy of the ball urge it toward the rib when the balloon is partially filled with water when oriented vertically.

Various embodiments provide balloons which define elastomeric bodies and necks. The balloon bodies define body thicknesses and filled and unfilled internal volumes between which the balloons expand and contract when being filled and emptied respectively with a first liquid. Tension in the balloon bodies gives rise to internal pressures when the balloons are filled. The necks of the current embodiment couple with the bodies and define ribs with thicknesses which differ from the body thicknesses.

In some embodiments the rib thicknesses are greater than the body thicknesses. Moreover, the ribs can define concave surfaces when viewed from a longitudinal axis of the balloon passing through the balloon neck. The balloons of some embodiments also comprise check valve balls which are buoyant with respect to the liquid and which are located within the balloon body. The internal pressure tends to hold the check valve ball in the rib when the balloon is partially filled with the liquid. Balloons of some embodiments define overall thicknesses which vary continuously with distance along a longitudinal axis of the balloons and which further defines the body and rib thicknesses.

Balloon ribs of various embodiments define meniscus regions. Further, some of these meniscus regions are defined by differences between the diameters of the balloon bodies and necks (the latter diameter often being less than the former diameter). Additionally, or in the alternative, some balloons comprise lips which define lip diameters and meniscus regions.

In accordance with some embodiments, methods of manufacturing balloons are provided herein. Some methods, for instance, comprise at least partially immersing a mold in a liquid elastomer. The mold, furthermore, comprises a balloon body portion, a balloon lip portion, and a balloon neck portion between the body and lip portions. The portions each having a circumference wherein the circumferences of the neck portions are less than the circumferences of at least one of the body and lip portions. Methods in accordance with the current embodiment also comprise drawing the mold from the liquid elastomer at a (variable) rate sufficient to coat the mold with the liquid elastomer. As a result, a thickness of the coating on the neck portion can be different than a thickness of the coating on at least one of the body or lip portions. Additionally, such methods comprise forming the balloon lip from the elastomer on the lip portion. In some embodiment the mold includes a flat area proximal to, or on, the neck portion. Moreover, a (buoyant) check valve ball can be inserted into the balloon and compressed air can be used to aid the insertion.

Additionally, methods in accordance with the current embodiment can comprise molding a first biodegradable material (for instance wood) comprised of fine particles into a generally spherical ball-shaped substrate. Oils in the wood can bind the particles together or a binding agent can be used for such purposes. In the alternative or in addition, some methods also comprise coating the spherical substrate with a second biodegradable material (and drying the coating). Beeswax can be used for the coating. Furthermore, the coated spherical ball can be made in such a way as to possess a density which differs from the density of the water and so that it possesses a total mass of no more than about 480 mg. As a result, if the coated spherical ball is thoroughly wetted with water and traveling at about 70 feet per second and encounters a human, it does not injure the human. Some methods comprise de-burring the generally spherical substrate to form the spherical ball and/or dividing a bulk material into the fine particles. The balls can be inserted into the balloons in accordance with some embodiments.

Various embodiments provide check valve balls for use with water and/or other liquids. These check valve balls can comprise a ball that further comprises a generally spherical substrate of fine particles of a biodegradable material and a coating on the substrate. The coating can be made of biodegradable material also. Combined, the coating and the generally spherical substrate form the check valve ball and possess a density differing from the water density. Further the check valve ball possesses a total mass of no more than about 480 mg. Thus if the coated spherical ball is thoroughly wetted with water and traveling at about 70 feet per second and contacts a human, it does not injure the human. Check valves of some embodiments can further comprise balloon necks which are configured to receive the check valve ball thereby forming self-sealing water balloons. A binder can be included in the check valve ball to bind its particles together and/or the check valve ball can be coated with beeswax.

Some embodiments provide molds for self-sealing balloons which comprise balloon body, neck, and lip portions each defining a circumference. Moreover, the neck portion can be between the lip and body portions and its circumference can be less than either (or both) of the lip and body portions. The neck portion can therefore define a fillet. Furthermore the mold (or perhaps just the neck portion) can be made of a material having a selected wetting property such that, in conjunction with a characteristic dimension of the fillet, the mold draws a selected liquid elastomer into a region adjacent to the fillet to form a meniscus region.

To the accomplishment of the foregoing and related ends, certain illustrative aspects are described herein in connection with the annexed figures. These aspects are indicative of various non-limiting ways in which the disclosed subject matter may be practiced, all of which are intended to be within the scope of the disclosed subject matter. Other novel and nonobvious features will become apparent from the following detailed disclosure when considered in conjunction with the figures and are also within the scope of the disclosure.

BRIEF DESCRIPTION OF THE FIGURES

The detailed description is described with reference to the accompanying figures. In the figures, the left-most digit(s) of a reference number usually corresponds to the figure in which the reference number first appears. The use of the same reference numbers in different figures usually indicates similar or identical items.

DETAILED DESCRIPTION

This document discloses balloons, self-sealing water balloons, components thereof and related systems, apparatus, methods, etc.

Some embodiments provide water balloons which can be filled and which maintain water inside without leaking (without the need to be tied off). While a ball, sphere, of other type of stopper can be used to seal the balloon (from within) other devices can serve as check valves to allow the balloon to be filled while also stopping the water (or other fluid) therein from flowing or leaking out of the balloon. Furthermore, the balloons (and check valves thereof) can be designed to have a limited self-sealing lifetime once filled with water.

Balloons of some embodiments can be said to have distinct parts such as a body, a neck, a lip, ribs, seating shoulders, etc. These distinct parts, though, can be formed as a singular, unitary object in which the "parts" merely refer to portions of the unitary balloons and, indeed, can overlap. However, the various parts of these balloons can have differing thicknesses.

Further still, some embodiments include check valves in the balloons. For instance, a ball of compacted wood particles can be coated with beeswax and inserted into a balloon so that it plugs the neck of the balloon when the balloon is fall. In some embodiments, the check valve is a gel cap that seals the neck of the balloon. Thus, the check valve balls need not be spherical. For instance, they can be oblong, ellipsoidal, egg-shaped, etc. In the alternative, or in addition, the check valve can include a polyethylene ball and can be used when the users do not desire the check valve balls to smudge (however temporarily) surfaces that they might contact.

Moreover, the check valves can include cartridge check valves inserted into the balloons. In some embodiments, the cartridge check valve comprises a tube with a tapered inner wall and a check valve ball retained therein. Accordingly, a cartridge check valve can be inserted into the neck of a balloon and the check valve ball will seal against the tapered wall (with the tube sealing against the neck of the balloon). Of course other check valve devices can be used in conjunction with balloons to provide auto-sealing balloons. Moreover, these check valve devices can be made of a variety of materials (either biodegradable and otherwise). Check valves of embodiments which resist degradation can be re-used.

Chemically-based check valves can be used in accordance with embodiments. These chemically-based check valves can include adhesives that set in the presence of water (or other fluids) and/or chemicals that are injected into the necks of the balloons and that form solid/semi-solid materials in the presence of water. The latter form of chemically-based check valves could seal the balloons after they set. Having generally considered some embodiments it might now be helpful to turn to the figures.

Figure 1:
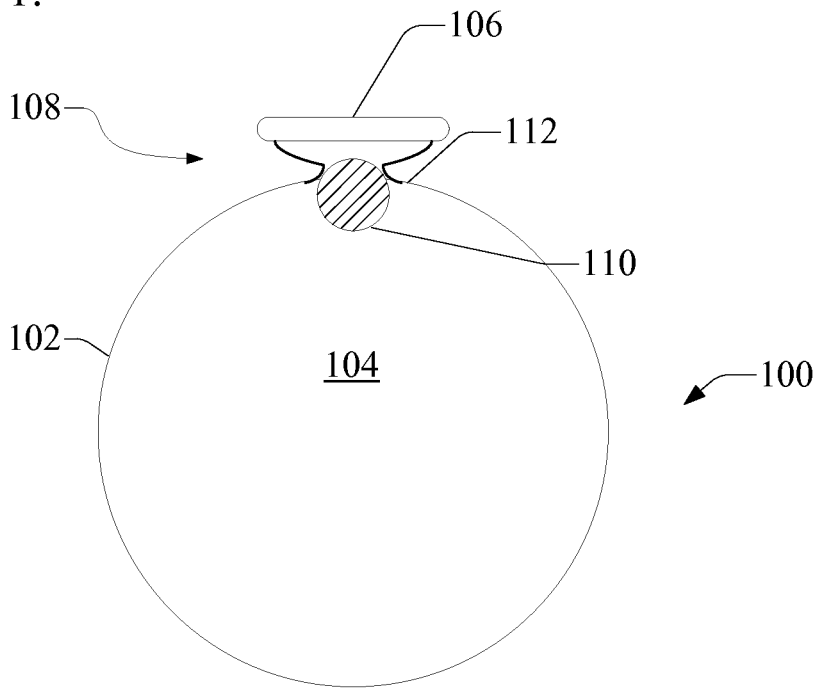
FIG. 1 illustrates a cross-section of a self-sealing water balloon.

FIG. 1 illustrates a cross-section of a self-sealing water balloon. The balloon 100 includes an elastomeric body 102 which defines an internal volume 104. In FIG. 1, the balloon 100 happens to be filled with a liquid so that the balloon body 102 is expanded and stretched taut. Being taut of course can facilitate the balloon's impact-induced "explosion." Moreover, the balloon 100 also includes a lip 106 and a neck 108 situated between the lip 106 and the body 102.

As is further disclosed herein, the neck 108 can define a rib. In the current embodiment, the lip 106 is a thickened area of the balloon body 102 and allows users to inject air, water, and other fluids into the balloon 100. Of course, that fluid flows through an aperture defined by the lip 106 and thence through the neck 108 into the internal volume 104. If not sealed, that aperture can allow the fluid in the balloon 100 to escape.

The balloon 100 illustrated by FIG. 1 also includes a check valve formed from a check valve ball 110 and a seating shoulder 112. The check valve ball 110 is a spherical ball and has a density different than the fluid in the internal volume 104 (or intended to be in the balloon 100). Of course, in many instances that fluid will be water but a large variety of fluids can be in the balloon 100. For instance, in some cases the balloon 100 might be used to collect bodily fluids, industrial fluids, wastewater, environmental samples, etc. But, for those cases in which the fluid is water, the check valve ball 110 can be either denser or less dense than the water. Of course, the check valve ball 110 could have a density equal to that of water (or other fluid) if desired.

With continuing reference to FIG. 1, the seating shoulder 112 can be formed at or near the neck 108. And, more specifically, the seating shoulder 112 can be formed in the area where the body 102 and neck 108 join. Thus, the check valve ball 110 can seat against the seating shoulder 112 thereby sealing the balloon 104 and preventing the fluid therein from exiting via the neck 108 and lip 106. More specifically still, the taut skin of the body 102 tends to impart an internal pressure to the fluid which causes it to flow toward the neck 108 while the balloon is unsealed. Thus, the cheek valve ball 110 will tend to flow with the water until it encounters the seating shoulder 112. It then comes to rest against the seating shoulder 112 with the internal pressure pushing it against (and into) the seating shoulder 112. At some point the force exerted against the check valve ball 110 by the seating shoulder 112 (and/or the skin of the body 102) balances the force imparted thereon by the internal pressure.

The check valve ball 110 can therefore come to rest seated in the seating shoulder 112. It has been found, moreover, that the check valve ball 110 will stay seated and continue sealing the balloon 100 despite the orientation and/or (potentially 6 degree freedom) movement of the balloon 100. Indeed, it has been found that the check valve ball 110 seals the balloon 100 despite the balloon 100 being thrown as in a water balloon fight or otherwise launched (such as by a on designed for use therewith).

Figure 2:
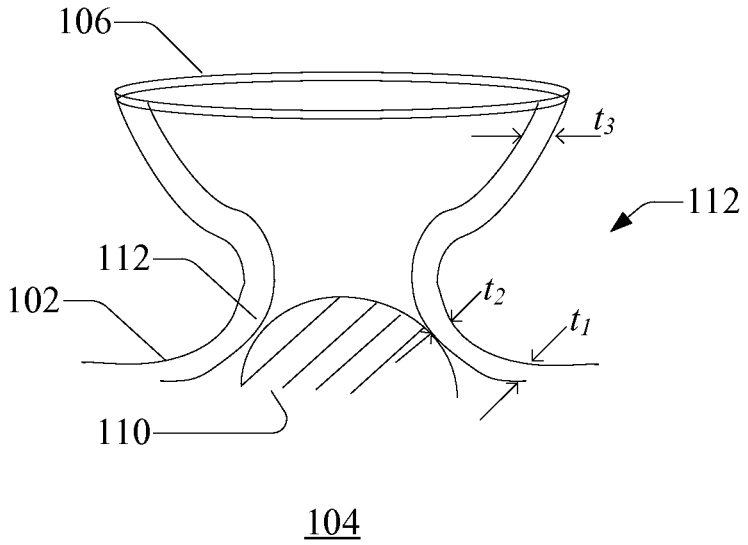
FIG. 2 illustrates a detail view of the self-sealing water balloon of FIG. 1.

FIG. 2 illustrates a detail view of the self-sealing water balloon of FIG. 1. More specifically, FIG. 2 illustrates various features related to sealing the balloon 100. For instance, FIG. 2 illustrates the thicknesses t1, t2, and t3 of the body 102 and of the neck 108 in two locations (one at its thickest section and one at a thinner area near the lip 106). The thickest area with thickness t2 is the seating shoulder 112 of the current embodiment. Balloons of the current embodiment are made of latex although balloons 100 of various embodiments can be made from many other elastomers too numerous to list herein. Of course, balloons of uniform thickness can be used with the check valves disclosed herein to form self-sealing balloons.

Table 1, below, shows some typical but non-limiting dimensions, weights, etc. of balloons of some embodiments.

TABLE 1

Non-Limiting Design Feature of Self-Sealing Balloons of Embodiments

| | | |
|---|---|---|
| Ball/Sphere | Size (nominal): | 10 mm = 0.394 in |
| Mass (nominal): | Wood 260 mg | |
| | Polyethylene 480 mg | |
| Balloon Travel Est. Speed | Thrown | 25 mph = 37 fps |
| | Shot | 70 mph = 100 fps |
| Latex Balloon Wall Estimated Thickness | 0.005-0.008 in or 0.127-0.203 mm | |
| Diameter of | Thrown | 3.00 in |

TABLE 1-continued

Non-Limiting Design Feature of Self-Sealing Balloons of Embodiments

| | | |
|---|---|---|
| Filled Balloon | Shot | 2.50 in |
| Time to Seal Filled Balloon Without Appreciable Degradation | 20 minutes with 80% efficiency | |

Figure 3:
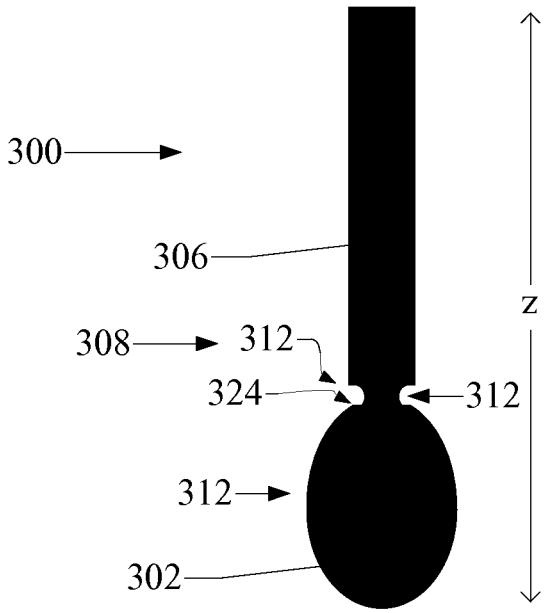
FIG. 3 illustrates a mold stem for manufacturing balloons.

FIG. 3 illustrates a mold stem for manufacturing balloons. The mold stem 300 of the current embodiment is dipped into a liquid elastomer (for instance, latex) and drawn out of it at a rate sufficient to leave a coating of the liquid elastomer on the mold stem 300. As the elastomer dries (or sets) it forms a balloon 100 corresponding in shape and size to the mold stem 300.

The mold stem 300 illustrated by FIG. 3 includes or defines three general portions. These portions include a body portion 302, a lip portion 306, and a neck portion 308. The body, lip, and neck portions 302, 306, and 308 can be used to form, respectively, the body 102, lip 106 and neck 108 of various balloons 100. Note also that the mold stem 300 forms one or more fillet portions 312 at or near the neck portion 308. Moreover, the mold stem 300 can be formed from wood, ABS (Acrylonitrile Butadiene Styrene) plastic, or other materials capable of being formed with a smooth enough surface to prevent significant defects in the skins of the balloons 100.

With continued reference to FIG. 3, the body portion 302 possesses a generally spherical or bulbous shape. That shape, in the current embodiment, imparts a corresponding shape to the balloon body 102. Thus, mold body portions 302 of various shapes can be used to manufacture balloons 100 having many different overall shapes. More specifically, the mold stem 300 of the current embodiment has a body portion 302 with a diameter (or circumference) larger than that of the lip portion 306 and/or the neck portion 308. Thus, balloons 100 formed from the mold stem 300 of the current embodiment have larger bodies 102 capable of holding more water, air, or other fluids. In some embodiments, the diameter of the body is about 3 inches when filled.

As to the lip portion 306, it is elongated so that sufficient elastomer adheres thereon from which to form the lip 106. That lip 106 can be formed by rolling the elastomer down the mold stem 300 while it is still semi-dry (or tacky). This can be done with a set of rotating brushes which cause the elastomer to curl over itself as the brushes (and the curling elastomer) travel along the mold stem 300. As it is rolled down the mold stem 300, the tacky elastomer continues curing and thereby forming the lip 106.

Still with reference to FIG. 3, the neck portion 308 of the mold stem 300 of the current embodiment forms the neck 108 and/or seating shoulder 112 of balloons 100. More specifically, the neck portion 308 defines a diameter (or circumference depending on its shape) that is less than either or both of the diameters (or circumference) of the body and/or lip portions 302 and 306. Thus, the neck 108 of the balloons 100 formed thereon will tend to be smaller than the bodies 102 and lips 106 of the balloons 100.

In some embodiments, the fillet portions 312 assist in forming the neck 108 and/or the seating should 112 (see FIG. 3). More specifically, and as noted elsewhere herein, the neck portion 308 can be made of a material which wets comparatively well when in contact with the liquid elastomer. Thus, it is believed that capillary forces tend to draw the liquid elastomer into capillary-like features of the mold stem 300 (for instance, the relatively confined regions adjacent to the fillet portions 312). The fillet portions 312 might therefore tend to retain more of the liquid elastomer than other surfaces of the mold stem 300. As a result, when the mold stem 300 is drawn from the liquid elastomer, more elastomer remains on the fillet portions 312 than elsewhere. The resulting balloons 100 will probably therefore have a thicker cross-sectional area in the corresponding region (the seating shoulder 112). In other words, the meniscus that is believed to form adjacent to the fillet portion 312 gives rise to the thickness t2 of the seating shoulder 112.

That thickness t2 provides more material against which the check valve ball 110 seats. The extra material reinforces the neck 108 in the vicinity of the seating shoulder 112 and prevents (in some embodiments) the cheek valve ball 110 from tearing through the balloon 100 in that area. Moreover, should the seating shoulder 112 be of insufficient strength to completely resist the force of the check valve ball 110 (acting under the pressure and/or buoyant forces in the balloon) the neck 108 will likely collapse upon the lip 106. The lip 106 (with its extra material as compared to the remainder of the body 102) can therefore aid in retaining the check valve ball 110 and sealing the balloon 100 of the current embodiment. While the foregoing has disclosed certain methods of forming the thickened/reinforced seating shoulder 112, other methods of forming them are within the scope of the current disclosure. For instance, the mold stem 300 can be withdrawn from the liquid elastomer at a varying rate so as to leave various portions of the mold stem 300 coated with more/less elastomer than other areas.

Figure 4:
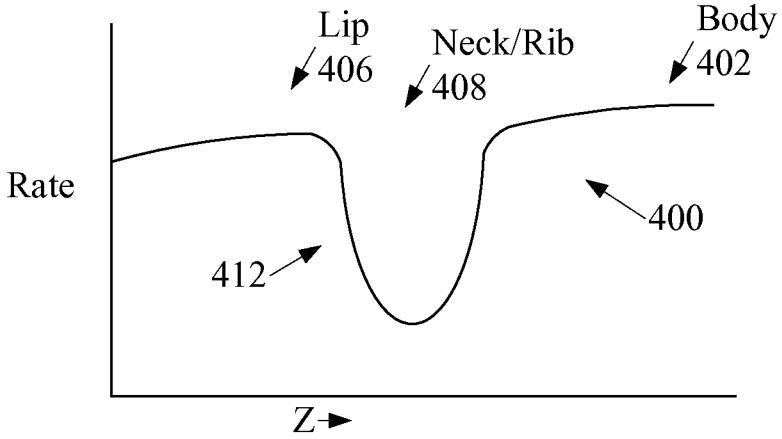
FIG. 4 illustrates a graph of the rate at which mold stems are drawn from a liquid elastomer.

FIG. 4 illustrates a graph of the rate at which mold stems can be drawn from a liquid elastomer. More specifically, FIG. 4 shows a graph 400 of the rate that the mold stem 300 is withdrawn as a function of the position z at which the liquid surface is on the mold stem 300. The graph 400 defines several portions such as body rate 402, lip rate 406, neck rate 408, and fillet rate 412. In accordance with the current embodiment, each portion of the graph 400 corresponds to a portion of the balloons 100 manufactured with the mold stem 300.

For instance, a particular rate (selected based on the liquid elastomer to be used and the material of the mold stem 300) can be used to leave a desired thickness t3 on the lip portion 306 of the mold stem 300. See lip rate 406. That rate can be reduced to slow the rate at which the mold stem 300 is withdrawn while material is being deposited or coagulated on the fillet portion 312 of the mold stem 300. Accordingly, FIG. 4 illustrates the rate being ramped down from the lip rate 406 to the fillet rate 412. A different rate can be selected for coating other portions of the neck portion 308 such that the neck rate 408 can be approximately steady. Then, as the second fillet portion 312 emerges from the liquid elastomer, the rate can be ramped up to the fillet rate 412 (or, perhaps, some other rate). Finally, in accordance with the embodiment illustrated by FIG. 4, the mold stem 300 can be withdrawn at a body rate 402 to coat the body portion 302 to some desired thickness. Of course, graph 400 depicts but one rate profile whereas those skilled in the art will recognize that a rate profile for a particular balloon will reflect a number of variables and/or user selections. These variables include the wetting ability of the mold stem 300 (or portions thereof), the properties of the elastomer, the sought after balloon skin thickness or thicknesses, the drying/setting time of the liquid elastomer, environmental temperature, etc. Another factor that can be considered in manufacturing such balloons is whether the amount of liquid elastomer retained on the mold stem 300 is inversely proportional to the rate or speed of withdrawal.

Accordingly, the rate profile illustrated by FIG. 4 is presented for illustrative purposes and is non-limiting. The manner in which the rates can be varied are also non-limiting. For instance, a variable frequency drive can be used to vary the speed of the motor withdrawing the mold stem from the liquid elastomer. In the alternative, or in addition, the mold stem can ride along a manufacturing rail which has height-profile tailored to dip and/or withdraw the mold stem from the liquid elastomer at a varied rate.

Figure 5:
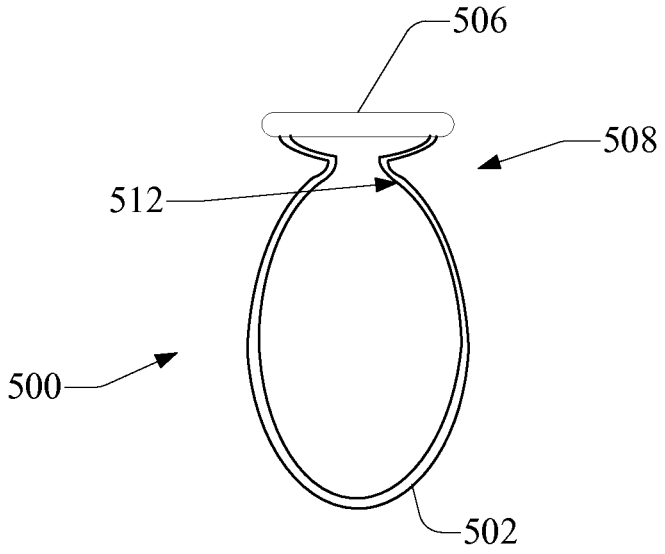
FIG. 5 illustrates a cross-section of a balloon.
Figure 6:
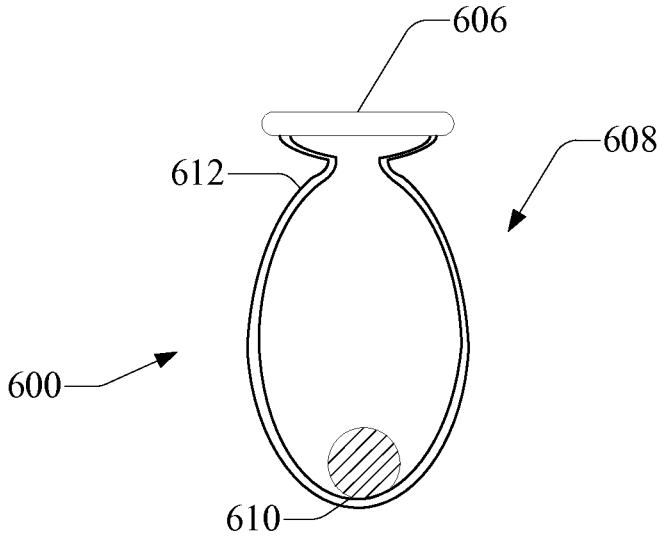
FIG. 6 illustrates a cross-section of a self-sealing water balloon.

FIG. 5 illustrates a cross-section of a balloon. The balloon 500 of FIG. 5 has been formed with a body 502 reflecting the bulbous shape of the body portion 302 of the mold stem 300. Lip portion 506 corresponds to portion 306 of the mold stem 300. Neck portion 508 corresponds to portion 308 or stem 300. In addition, it possesses a seating shoulder 512. Note that the balloon 500 can be used as is (without a check valve ball) or with a check valve ball in accordance with embodiments. FIG. 6 illustrates a cross-section of a self-sealing water balloon. In FIG. 6, a check valve ball 610 has been inserted into the balloon 600 to form a self-sealing balloon in accordance with embodiments. Thus, it can be filled with water (or some other liquid) and used as desired without being tied off.

Figure 7:
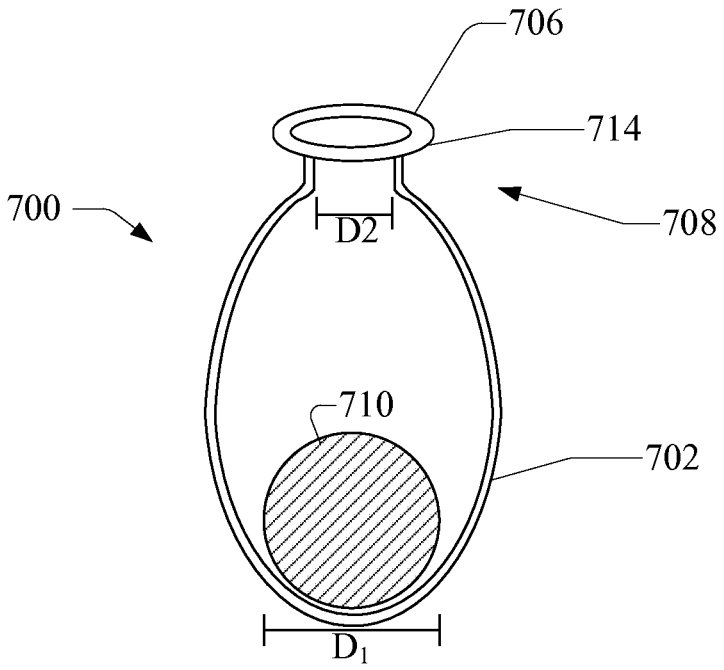
FIG. 7 illustrates another cross-section of a self-sealing water balloon.

FIG. 7 illustrates another cross-section of a self-sealing water balloon. More specifically, FIG. 7 illustrates a balloon 700 with a relatively deflated and elongated body 702. This elongated body reflects the shape of the body portion of the mold stem on which it was formed. Similarly, its neck 708 possesses an elongated shape which spans more distance between the body 702 and the lip 706 than the distance between the body 602 and the lip 606 of balloon 600 (see, FIG. 6). In some embodiments, the length of the neck 708 is about 1 inch. Moreover, the neck 708 and lip 706 merge along a comparatively straight line rather than the are illustrated between neck 608 and the lip 606 (which expands the diameter of the neck 608 as it approaches the lip 606).

It has been found that the configuration of balloon 600 can improve the ability to fill the balloon 600 (as compared to the balloon 700) using automated or semi-automated machinery. More specifically, the shorter-necked balloon 600 can be held in a magazine (by the relatively short neck 608) and aligned with a fill nozzle (not shown) using the magazine. Moreover, the shorter-necked balloon 600 reduces or eliminates the need for indexing/orienting the balloon 600 before it is launched from a water balloon gun designed for use therewith. That short neck 608 also reduces the likelihood of snags between the balloon 600 and the gun (or other automated or semi-automated handling equipment). Furthermore, it reduces friction and/or stiction between the balloon 600 and the machinery that might otherwise develop. In contrast, the longer neck 708 of balloon 700 improves the ability of users to manually "tie-off" the neck thereby sealing the balloon if it is desired to do so and/or no check valve ball 710 is present.

Figure 8:
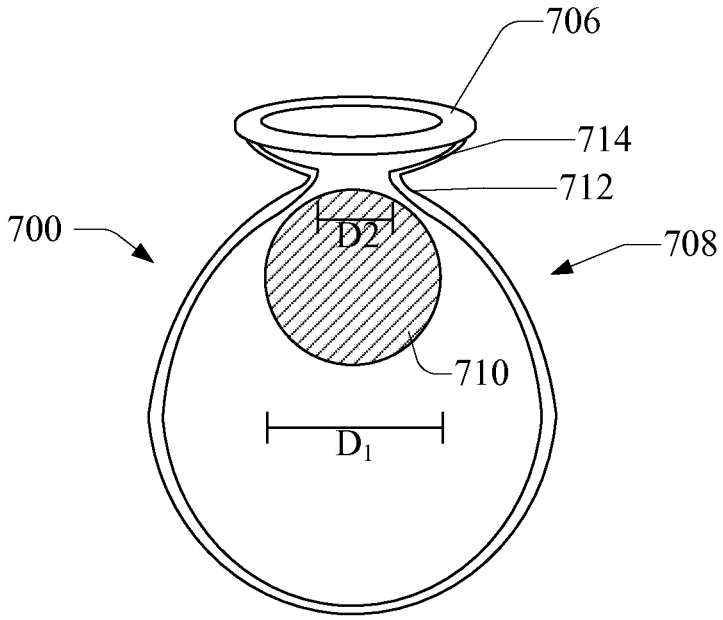
FIG. 8 illustrates yet another cross-section of a self-sealing water balloon.

FIG. 8 illustrates yet another cross-section of a self-sealing water balloon. More specifically, FIG. 8 shows the balloon 700 as being filled with a liquid (for instance water). The check valve ball 710 has been urged into place in the neck 708 (or rather against the seating shoulder 712) by a combination of buoyant forces and/or the internal pressure of the balloon 700. As such, it seals the balloon 700 and prevents the liquid (and/or any gases therein) from leaking from the balloon 700. As those skilled in the art will recognize, the degree to which the check valve ball 710 and seating shoulder 712 seal the balloon can be determined by the mechanical and geometric properties of the check valve ball 710 and seating shoulder 712. Thus, for instance, when the balloon 700 is intended to hold water for recreational use, a lesser degree of sealing could be chosen to, for instance, lower manufacturing costs. However, when the balloon 700 is intended to hold more sensitive liquids (for instance, bodily fluids waste, fuel, etc.) the balloon 700 can be designed with a greater degree of sealing capability. Likewise, the lifetime of the check valve ball can be set by appropriate user choices so that it degrades noticeably after some desired time.

Figure 9:
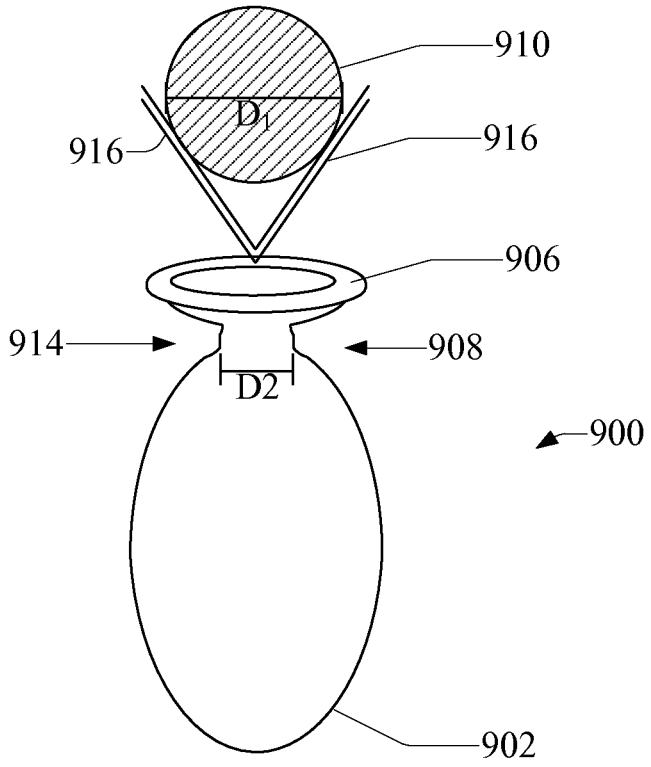
FIGS. 9-11 illustrate a method of inserting a check valve ball into a balloon.
Figure 10:
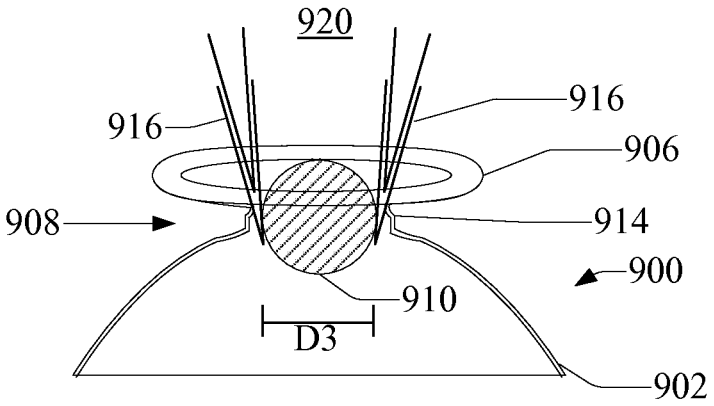
Figure 11:
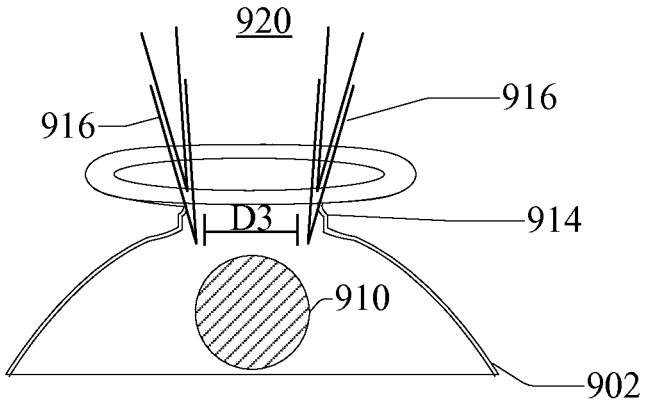

FIGS. 9-11 illustrate a method of inserting a check valve ball into a balloon. More specifically, FIG. 9 illustrates a pair of jaws 916 holding a check valve ball 910 which is ready for insertion into the balloon 900. FIG. 9 also illustrates the check valve ball 910 has a first diameter D1 whereas at least a portion 914 of the neck 908 has a diameter D2 which is less than the ball diameter D1. The jaws 916, it is noted here, taper together to a point (or at least an end which has a diameter smaller than both the ball diameter D1 and the neck diameter D2. Thus, the jaws 916 hold the check valve ball 910 between themselves. While they can also be inserted through the lip 906 and neck 908, the jaws 916 are illustrated as being just outside of the lip 906 and/or the neck 908.

FIG. 10 illustrates the jaws 916 as being partially inserted into the balloon 900. FIG. 10 also illustrates that the distance that the jaws 916 can be inserted into the balloon is enough to position the distal end of the jaws 916 beyond any point of the neck 908 having an unstretched neck diameter D2 less than the ball diameter D1. That distance (and the length of the neck 908) can be chosen in conjunction with one another so that the portion 914 of the neck 908 to be engaged (and stretched) by the jaws 916 will have sufficient resilience to withstand that stretching.

FIG. 11 illustrates the jaws 916 as having been opened. Accordingly, the portion 914 of the neck 908 has been stretched to a diameter D3 sufficient to allow the check valve ball 910 to pass there through. Indeed, FIG. 11 illustrates the check valve ball 910 as having moved through the neck 908 and into the body 902 of the balloon 900. The jaws 916 can then be closed thereby relaxing the portion 914 of the neck 908 and trapping the check valve ball 910 in the balloon 900.

While FIGS. 9-11 illustrate the check valve ball 910 being gravity-fed into the balloon, such arrangements are not necessary. For instance, the balloon 900 and check valve ball 910 could be held in any orientation (for instance, horizontally, inverted, etc.) with compressed air 920 or some other gas (or a device) providing the motive force to inject the check valve ball 910 into the balloon.

Furthermore, the check valve ball 910 could be heavier than the fluid or liquid to be sealed in the balloon 900. In that case, the check valve ball 910 would seal the balloon acting under the internal pressure in the balloon 900. Indeed while the weight of the check valve ball 910 might partially offset the pressure-based force, that pressure could still be enough to hold the check valve ball 910 against the seating shoulder. For instance, an appropriately sized marble was used to successfully seal a water balloon even when the balloon was positioned with the neck pointing up. Initially, the marble was moved into position against the seating shoulder by orienting the filled balloon 900 with its neck pointing down such that the marble settled onto the seating shoulder. Once the marble was seated, though, it stayed in place despite the balloon being thrown/tossed/launched.

Figure 12:
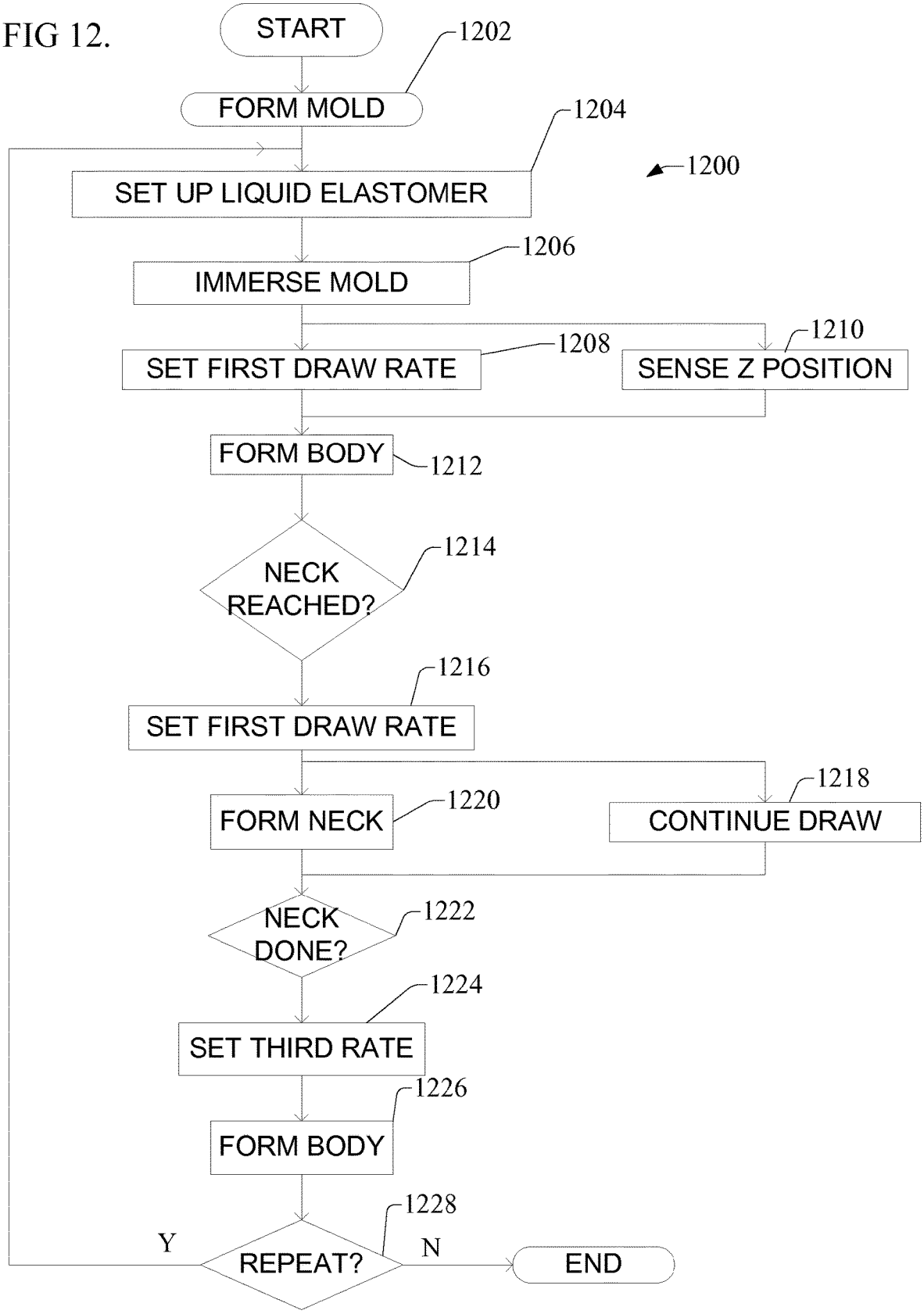
FIG. 12 illustrates a flowchart of a method for manufacturing balloons.

FIG. 12 illustrates a flowchart of a method for manufacturing balloons. More specifically, FIG. 12 illustrates the method 1200 which can begin with forming a mold stem 300 for manufacturing balloons such as balloon 700. The shape and dimensions of the mold stem 300 can be chosen to produce balloons of a desired shape and set of dimensions. Moreover, the mold stem 300 can be formed from a material (s) having wetting properties selected to work in conjunction with the liquid elastomer it will be immersed in to form the balloons 700. See reference 1202.

At reference 1204, a body of liquid elastomer can be formed. That elastomer can be latex, natural rubber, unvulcanized rubber, polychloroprene, etc. Moreover, various additives such as curing agents, accelerators, oil, lubricants, pigments, thickeners, dilutents, coagulants, and/or water can be mixed with the latex to yield a set of properties suitable for use with the chosen mold stem 300.

Figure 13:
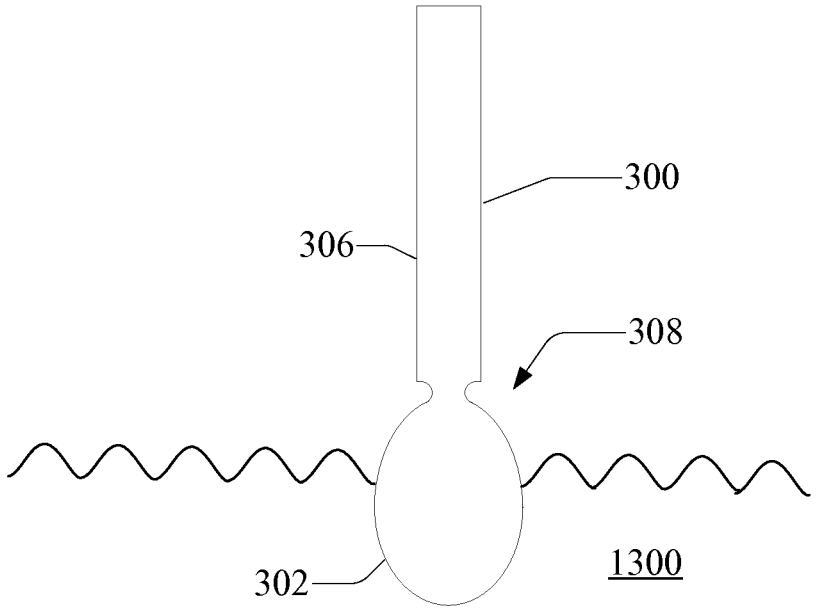
FIG. 13 illustrates a stem mold immersed in a liquid elastomer.

The mold stem 300 can also be treated to improve its properties for use in method 1200. For instance, a coagulant can be applied to the mold stem 300 (or selected portions thereof such as the neck portion 308) to enhance the ability of the elastomer to adhere thereto. The mold may then be immersed in the elastomer. See reference 1206. See FIG. 13 which illustrates the mold stem 300 partially immersed in a liquid elastomer 1300.

Furthermore, the mold stem 300 can then be withdrawn from the liquid elastomer 1300 as illustrated at reference 1208. The rate at which it is withdrawn may vary. For instance, differing rates may be chosen while the lip portion 306, the neck portion 308 (and/or the fillet portions 312), and the body portion 302 are drawn from the liquid elastomer 1300. These rates, moreover, need not be steady. For instance they can vary and can be timed (or indexed) to coincide with the time at which the various portions of the mold stem 300 are drawn from the liquid elastomer 1300. Such rates can be varied via a variable frequency drive or set by means of a manufacturing rail along which the stem molds 300 travel. See reference 1210.

For instance, a first rate of withdrawal can be used while the lip portion 306 of the mold stem 300 is being drawn from the liquid elastomer 1300. See reference 1212. A position sensor can be used in conjunction with the drive/mechanism withdrawing the mold stem 300 to determine when the neck portion 308 begins to emerge from the liquid elastomer 1300. See reference 1214.

Moreover, while the meniscus portions 312 of the mold stem 300 are at or near the surface of the liquid elastomer 1300, the rate can be adjusted to provide enough time for capillary forces to draw enough of the liquid elastomer 1300 to the fillet portions 312 to form the menisci. Thus, more liquid elastomer can coat the fillet portions 312 than other portions of the mold stem 300. Moreover, if the mold stem 300 defines a flat portion 324 or shelf (to retain additional material by means of gravity, viscous forces, surface tension, etc. or a combination thereof) then additional liquid elastomer 1300 can be deposited on the mold stem 300 at that location(s). See FIG. 3. Indeed, it is believed (and the mold stem 300 can be designed such that) surface tension between the flat portion 324 and the liquid elastomer 1300 can hold additional liquid elastomer in contact with the flat portion 324.

Moreover, one or more withdrawal rates can be set for withdrawing the neck portion 308 of the mold stem 300 from the liquid elastomer 1300. See reference 1216. The mold stem 300 can continue being withdrawn in accordance with that rate(s) as indicated by reference 1218. The neck 708 of the balloon 700 can begin thrilling as a result. See reference 1220.

As the neck portion 308 emerges from the liquid elastomer 1300, another withdrawal rate can be set for withdrawing the body portion 302 from the liquid elastomer 1300 as references 1222 and 1224. Accordingly, the body portion 302 of the mold stem 300 can be withdrawn from the liquid elastomer 1300 at that rate to begin forming the body 702 of the balloon 700. See reference 1226.

At some time, the mold stem 300 becomes completely withdrawn from the liquid elastomer 1300 in accordance with the current embodiment. The liquid elastomer 1300 can begin to dry or set (depending on the type of liquid elastomer involved) as it (or portions of it) emerges from the liquid elastomer. If desired, heat, quenching, and/or curing agents can be applied to encourage the formation of a solid or semi-solid elastomer on the mold stem 300. Thus, the balloon 700 of the current embodiment begins to solidify on the mold stem 300.

Once the liquid elastomer 1300 on the lip portion 306 of the mold stem 300 reaches a sufficiently dry or tacky state, the lip 706 of the balloon 700 can be formed. More specifically, a set of rotating brushes can be brought into contact with the proximal end of the nascent lip 706 while it is still adhering to the mold stem 300. These rotating brushes can contact the tacky elastomer and begin rolling it along the length of the lip portion 306 of the mold stem 300. As the brushing continues, the tacky elastomer rolls into a form in which it has a roughly spiral-shaped cross section. Moreover, because adjacent layers of tacky elastomer in that spiral are brushed into contact with one another, the adjacent layers are likely to adhere to one another. As those skilled in the art will recognize, in such situations, the tacky elastomer continues to cure thereby forming what appears to be a solid lip 706 but that might have a "spiral" cross-section. When the lip 706 is formed, the balloon 700 can be removed from the mold stem 300. If desired, additional balloons 700 can be formed by repeating method 1200 in whole or in part. See reference 1228.

Figure 14:
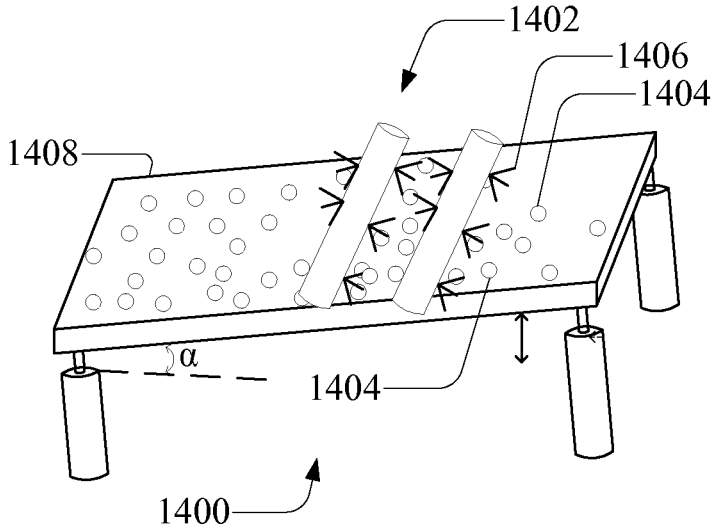
FIG. 14 illustrates a method of manufacturing check valve balls.

FIG. 14 illustrates a method of manufacturing check valve balls. More specifically, FIG. 14 illustrates a shaker table 1400, spray bars 1402, generally spherical substrates 1404, spray 1406, and check valve balls 1408. Generally, to manufacture check valve balls 1408 from generally spherical substrates 1404, users can employ the shaker table 1400 and spray bars 1402. More specifically, the shaker table 1400 is set at an angle A1 such that the generally spherical substrates 1404 can roll down it in accordance with the current embodiment. After they are molded, the generally spherical substrates 1404 can be fed on to one end of the shaker table 1400. That end of the shaker table 1402 can define a roughened surface which is configured to smooth, polish, etc. the generally spherical substrates 1404 into more spherical substrates 1404 as they roll along it. In some embodiments, any molding ribs, risers, etc. that might be present on the generally spherical substrates 1404 can be abraded away as the shaker table 1400 vibrates and as the generally spherical substrates 1404 roll along the subject portion of the shaker table 1400.

The (now more uniformly) spherical substrates 1404 continue along the shaker table 1400 until they encounter the spray 1406 created by the spray bars 1402. The spray can be of any coating suitable for preserving the spherical substrates 1404 while the check valve balls 1408 might be (subsequently) immersed in some liquid. For instance, the spray 1406 can be beeswax or some other biodegradable material. That spray 1406 coats the spherical substrates 1404 as they roll along the shaker table 1400. Indeed, because the shaker table 1400 can be configured to shake the spherical substrates 1400 in such a way that they rotate randomly about all three of their axes, the spherical substrates 1404 typically maintain a spherical shape rather than evolving into some other shape (for instance cylindrical).

Moreover, as the spherical substrates 1404 move along the shaker table 1400, they become more or less uniformly coated with the spray 1406 in accordance with the current embodiment. The coated spherical substrates 1404 exit the spray 1406 as they continue along the shaker table 1400. As they do so and/or thereafter, the coating dries or sets thereby forming check valve balls for use in self-sealing balloons and/or elsewhere. The finished coating can be smoother than the underlying substrate thereby improving the sealing of the balloon. Moreover, while the coated check valve ball 910 can protect the underlying substrate from the water (or other liquid in the balloon) for some time, it and the underlying substrate can be designed to bio-degrade rather quickly. For instance, some beeswax/particulate wooden check valve balls 910 can essentially disintegrate (to naturally occurring, non-polluting residues) within a week or so during typical summer weather.

Figure 15:
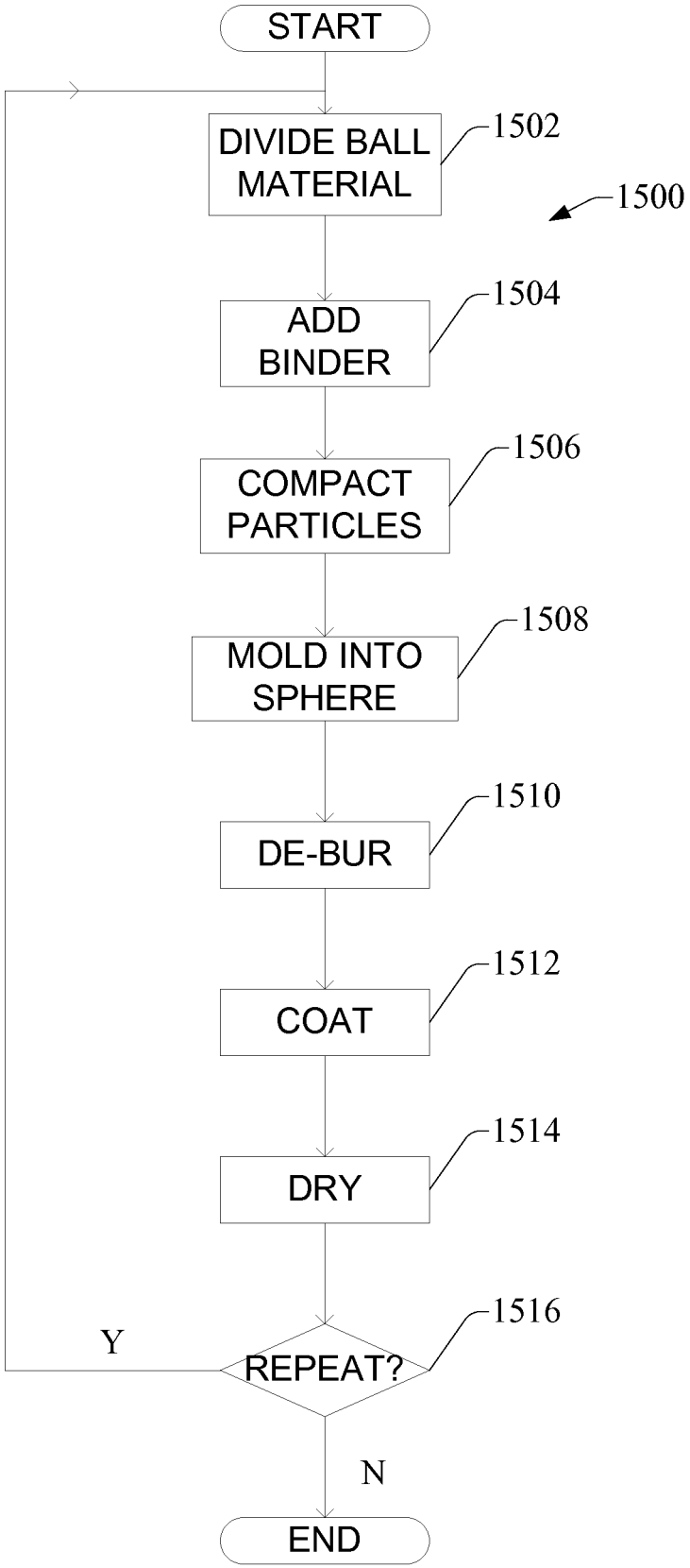
FIG. 15 illustrates a flowchart of a method of manufacturing check valve balls.

FIG. 15 illustrates another method of manufacturing check valve balls. More specifically, FIG. 15 illustrates that the method 1500 can include dividing a material for a substrate (of a check valve ball) into fine particles. For instance, a piece of wood such as pine, oak, ash, etc. can be divided into particles fine enough to provide the density, weight, resilience, etc. desired by the user. Of course other materials can be used to form the substrate and need not be divided into particles. In some embodiments, shredded paper, plastic, glass, etc. can be used to form the substrate. However, in accordance with embodiments reference 1502 shows that particles can be formed from at least some materials. The material of the check valve balls can be biodegradable but need not be so. In some embodiments in which the check valve balls and the balloons are both biodegradable, the materials can be selected so that they both degrade when exposed to typical environments within some selected time (such as 1 week). Even polyethylene check valve balls can be designed to degrade in the presence of ultraviolet light (in sunlight) with/without catalysts to enhance the biodegradation so that they degrade within a year or less following exposure to the environment. As those skilled in the art will understand, with check valve balls that biodegrade within a reasonable time, users might not need to collect the check valve balls of spent water balloons.

Reference 1504 illustrates that a binder can be added to the mass of particles to be formed into the matrix or substrate of the check valve ball. Of course, some materials will allow subsequent processing to be performed without adding a binder. For instance, some woods contain enough naturally occurring oil that the oil can serve as a binder sufficient to bind the check valve balls together for selected uses. Accordingly, the binder used can be selected based on the desired service environment of the resulting apparatus.

A desired amount of the particulate matter (with or without an added binder) can be measured into a mold. That mold can be used to compress the particulate matter into a generally spherical shape. See reference 1506. However, as can occur in many molding processes, certain burrs, "risers," stems, etc. can be formed on the substrate as an incidence of their manufacture. Since these burrs (if present) might interfere with the seal between the check valve ball and the balloon, method 1500 includes de-burring the generally spherical substrate manufactured during method 1500 in accordance with the current embodiment. See reference 1510. The material of these generally spherical substrates can resemble light-weight (low-density) particleboard or can be some other material.

At reference 1512 a coating can be applied to the now spherical substrate. That coating can be made of a material which is suitable to protect the substrate from contact with a liquid for a selected amount of time. For instance, the coating can be configured such that it protects the substrate from water for at least a few minutes. In some embodiments, that coating is beeswax and is applied in sufficient thickness to protect the substrate from water for about 20 minutes in about 80% of typical scenarios. In that way, the check valve ball can be inserted into a balloon, the balloon can be filled with water, and then used for leisure activities (for instance, in a water balloon fight with/without a water balloon gun) without being manually tied off.

Some coatings might behave more optimally if they are allowed to dry, cure, etc. after they are applied to the substrates. Thus, method 1500 includes drying the coating as illustrated at reference 1514. The result of method 1500 can be a spherical check valve ball of approximately 10 mm diameter sufficiently large to seal even many balloons heretofore available while also being light enough (about 480 mg or less) that even at 70 feet per second it would not hurt a human that it might contact. Of course, as might be desired, method 1500 can be repeated in whole or in part. See reference 1516.

Figure 16:
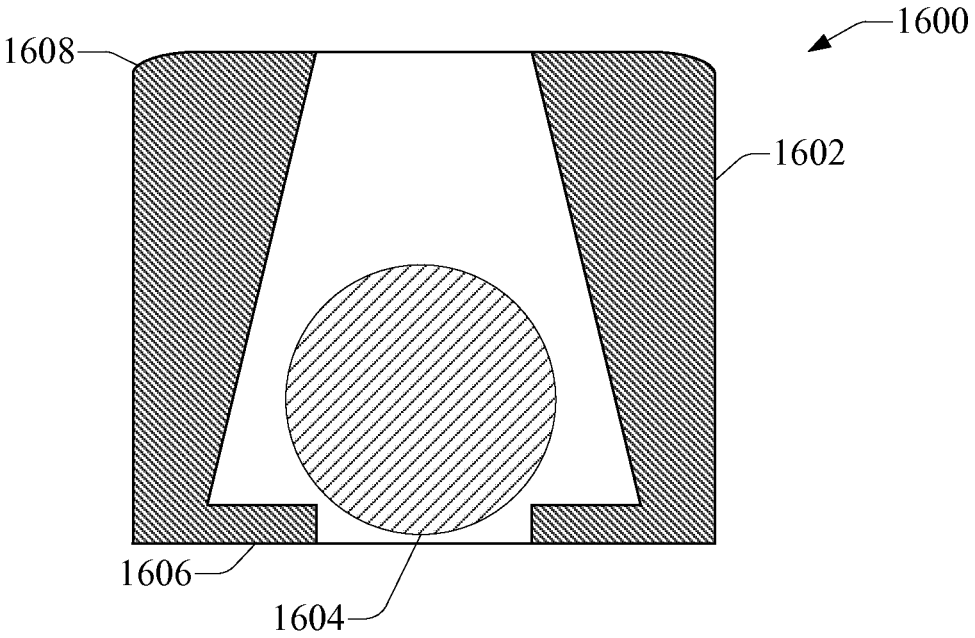
FIG. 16 illustrates a cartridge check valve.
Figure 16:
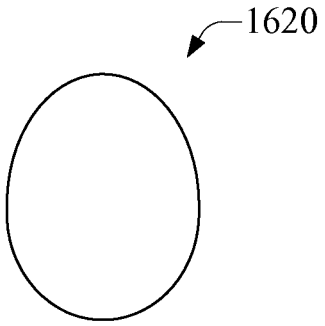

FIG. 16 illustrates a cartridge check valve of embodiments. More specifically, FIG. 16 illustrates a cartridge check valve 1600 which comprises a cylindrical cartridge 1602 and a check valve ball or stopper 1604. The cartridge 1602 is roughly cylindrical in shape and has inner walls that taper together. Moreover, the cartridge 1602 also defines a detent 1606 or other retention mechanism through which the stopper 1604 can be inserted. That detent 1604 can be configured such that it will retain the stopper 1604 within the cartridge 1602. The tapered inner walls can also retain the stopper 1604 in the body 1602. Thus, the stopper 1604 of the current embodiment is captured by the cartridge 1602.

Furthermore, the detent 1606 can be perforated or can define ridges such that water and/or other fluids can flow around the stopper 1604 when it abuts the detent. The other end of the body can be open. Thus, water can flow from the narrow (and open end) of the check valve 1600, around the stopper 1604, and out through the other end. In the other direction, though, the flow of water can urge the stopper 1604 against the tapered inner walls thereby sealing the balloon in which the check valve 1600 has been inserted. In addition to check valve 1600, FIG. 16 illustrates an ellipsoidal stopper 1620 that can be used in conjunction with the cartridge-like check valve 1600 or it can be used on its own within a balloon to seal the balloon directly.

Figure 17:
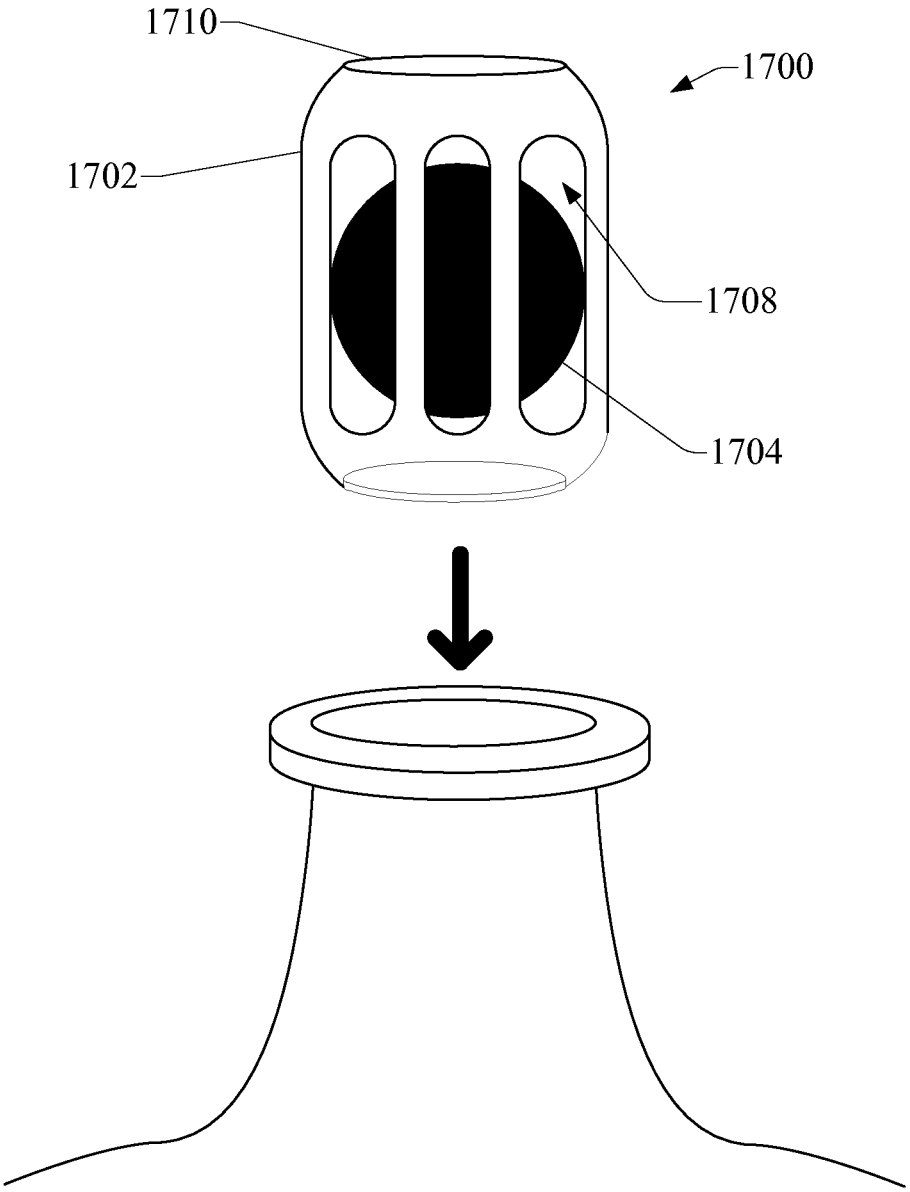
FIG. 17 illustrates another cartridge check valve.

FIG. 17 illustrates another cartridge check valve. The cartridge check valve 1700 of the current embodiment includes a body or cartridge 1702 and a stopper 1704 captured therein. The cartridge 1702 defines a plurality of longitudinal bypass paths 1708 which (when the cartridge check valve 1700 is in a balloon) allow fluid to flow into the balloon to fill it. On the other hand, when the balloon is full, the internal pressure urges the stopper 1704 against the seat 1710 at one end of the cartridge 1702 (which is itself abutting a seating area of the balloon) and closes off and/or seals the check valve (and balloon) against backflow. Indeed, in some embodiments, the cartridge 1702 and stopper 1704 are configured such that the bypass paths 1708 are closed off by the stopper 1704 when they are in those relative portion.

Figure 18:
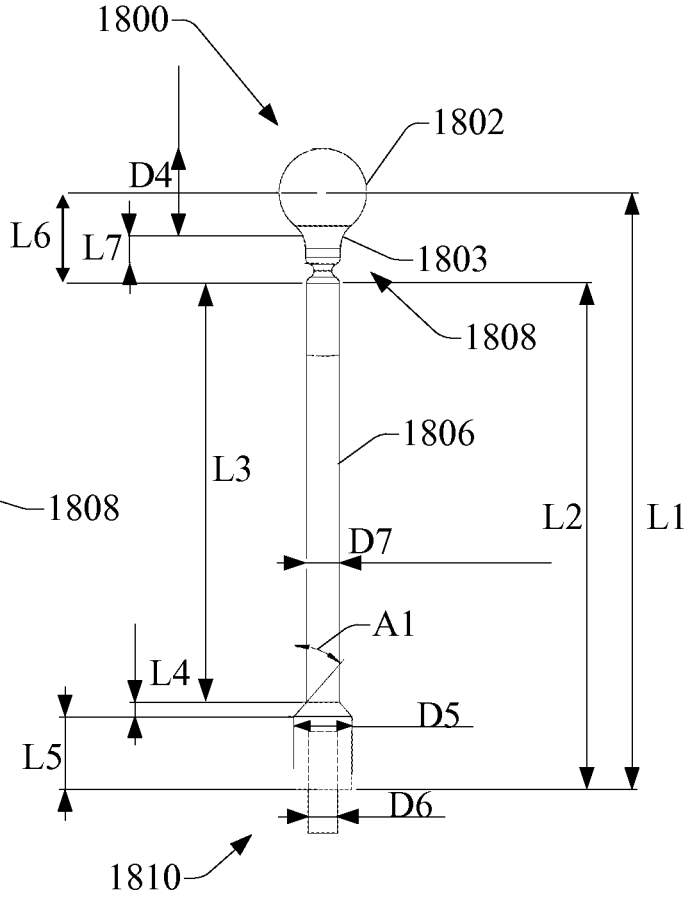
FIG. 18 illustrates another mold stem.

FIG. 18 illustrates another mold stem. The mold stem 1800 of the current embodiment includes a body portion 1802, a transition portion 1803, a lip portion 1806, a neck portion 1808, and an adapter 1810. The body portion is bulbous or generally spherical in shape and creates correspondingly shaped balloons. The transition portion 1803 tapers toward the neck portion 1808 such that the balloons wall also have a tapered and/or arcuate transition from their bodies to their necks. Meanwhile, the neck portion 1808 can be formed with three arcs so as to avoid corners and or intersecting surfaces that might introduce line-shaped or arc-shaped defects in the balloons formed thereon. Two of the arcs provide localized transitions from the transition portion 1803 and from the lip portion 1806, while the third arc lies there between.

Figure 19:
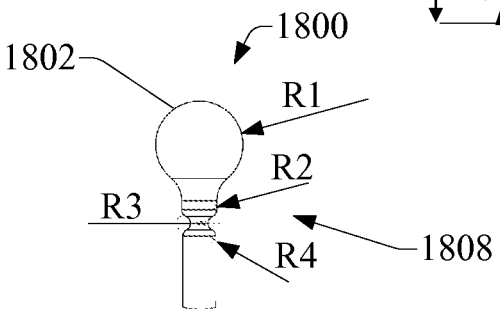
FIG. 19 is a detail view of the mold stem of FIG. 18.

With continuing reference to FIG. 18, the lip portion of the current embodiment can serve several functions. For instance, the lips of balloons can be formed on it while it can also extend far enough from the neck portion 1808 so that one end of the overall mold stem 1300 extends from the liquid elastomer into which it is immersed. Thus, the adaptor 1810 can be kept from contact with the liquid elastomer and can be removably attached to a moving manufacturing rail. The attachment can be by way of a ¼-20 male thread or other mechanical couplings for instance. Such arrangements allow manufacturing rails to immerse the mold stem 1800 in troughs of liquid elastomer and to withdraw them therefrom in accordance with the height-based profiles of the rails. FIG. 19 is a detail view of the mold stem of FIG. 18. Furthermore, Table 2 lists some non-limiting manufacturing dimensions of the mold stem 1800.

TABLE 2

Non-Limiting Mold Stem Dimensions

| Dimension | Size |
|---|---|
| L1 | 5.125" |
| L2 | 4.342" |
| L3 | 3.592" |
| L4 | 0.125" |
| L5 | 0.625" |
| L6 | 0.783" |
| L7 | 0.236" |
| D4 | 0.750" |
| D5 | 0.500" |
| D6 | 0.250" |
| D7 | 0.280 to .3125" |
| R1 | 0.375" |
| R2 | 0.063" |
| R3 | 0.063" |
| R4 | 0.063" |
| A1 | 41 degrees |

Embodiments disclosed herein provide balloons comprising seating shoulders at or near their necks. Various embodiments provide balloons with features enabling machinery to grip and/or index the balloons. Thus, balloons of some embodiments can be filled with fluids of various sorts by machinery in addition to, or in the alternative to, being filled manually. Some embodiments provide self-sealing water balloons while some embodiments provide check valve balls for sealing balloons and/or other objects. Furthermore, embodiments provide methods and/or apparatus (for instance, manufacturing jaws) for manufacturing balloons and/or their component parts.

CONCLUSION

Although the subject matter has been disclosed in language specific to structural features and/or methodological acts, it is to be understood that the subject matter defined in the appended claims is not necessarily limited to the specific features or acts disclosed above. Rather, the specific features and acts described herein are disclosed as illustrative implementations of the claims.

What is claimed is:

1. A self-sealing balloon produced by a process comprising:

immersing a mold in a body of liquid elastomer material, wherein the mold comprises a body portion and a neck region that includes: a first cylindrical portion adjacent to the body portion, a shoulder portion adjacent to the first cylindrical portion, and a second cylindrical portion adjacent to the shoulder portion, wherein:

the shoulder portion includes a first shoulder transition curve adjacent to the first cylindrical portion, a second shoulder transition curve adjacent to the second cylindrical portion, and a concave portion between the first and second shoulder transition curves;

the concave portion has a diameter that is smaller than a diameter of the first cylindrical portion and a diameter of the second cylindrical portion;

the first cylindrical portion has the same diameter over its length and its length is at least a third of its diameter; and respective outer surfaces of the first shoulder transition curve and the second shoulder transition curve are convex;

withdrawing the mold from the body of liquid elastomer material such that at least a portion of the self-sealing balloon formed on the shoulder portion has a greater thickness of elastomer material relative to other portions of the self-sealing balloon;

rolling a portion of the elastomer material formed by the second cylindrical portion to form a lip region;

removing the self-sealing balloon from the mold; and inserting an oblong gel capsule into an internal volume of the self-sealing balloon that is formed on the body portion of the mold, wherein the oblong gel capsule is configured to seal against at least the portion of the balloon formed by the shoulder portion and having the greater thickness to enclose the internal volume in response to the self-sealing balloon being filled with liquid.

2. The self-sealing balloon of claim 1, wherein the diameter of the second cylindrical portion is between 0.28 and 0.3125 inches.

3. The self-sealing balloon of claim 1, wherein inserting the oblong gel capsule into the internal volume uses compressed air.

4. The self-sealing balloon of claim 1, wherein a density of the oblong gel capsule is less than a density of water.

5. The self-sealing balloon of claim 1, wherein at least a portion of the shoulder portion of the mold is made of a material with a wetting property that draws the liquid elastomer material.

6. The self-sealing balloon of claim 1, wherein the gel capsule is egg shaped.

* * * * *